US011959469B2

(12) United States Patent
Wiesenack et al.

(10) Patent No.: US 11,959,469 B2
(45) Date of Patent: Apr. 16, 2024

(54) METHOD FOR MONITORING THE STATE OF A DEVICE AND DEVICE

(71) Applicant: Putzmeister Engineering GmbH, Aichtal (DE)

(72) Inventors: Carl Wiesenack, Munich (DE); Benjamin Hoelzle, Bad Urach (DE); Michael Schaefer, Gaeufelden-Tailfingen (DE); Wolf-Michael Petzold, Aichwald (DE); Jan-Martin Veit, Pliezhausen (DE); Wilhelm F. Hofmann, Niederdorfelden (DE)

(73) Assignee: Putzmeister Engineering GmbH, Aichtal (DE)

( * ) Notice: Subject to any disclaimer, the term of this patent is extended or adjusted under 35 U.S.C. 154(b) by 146 days.

(21) Appl. No.: 17/637,351

(22) PCT Filed: Aug. 20, 2020

(86) PCT No.: PCT/EP2020/073337
§ 371 (c)(1),
(2) Date: Feb. 22, 2022

(87) PCT Pub. No.: WO2021/032838
PCT Pub. Date: Feb. 25, 2021

(65) Prior Publication Data

US 2022/0307490 A1 Sep. 29, 2022

(30) Foreign Application Priority Data

Aug. 22, 2019 (DE) ..... 10 2019 212 631.6

(51) Int. Cl.
*F04B 15/02* (2006.01)
*F04B 9/113* (2006.01)
(Continued)

(52) U.S. Cl.
CPC ..... *F04B 15/02* (2013.01); *F04B 9/113* (2013.01); *F04B 51/00* (2013.01); *F04B 49/065* (2013.01);
(Continued)

(58) Field of Classification Search
CPC ..... F04B 9/113; F04B 49/103; F04B 51/00; F04B 2201/0201; F04B 2201/0903; F15B 19/005; F15B 2211/6336
See application file for complete search history.

(56) References Cited

U.S. PATENT DOCUMENTS 4,252,176 A 2/1981 Page
4,708,620 A 11/1987 Brugger
(Continued)

FOREIGN PATENT DOCUMENTS

CN 1788159 A 6/2006
CN 108217541 A 6/2018
(Continued)

OTHER PUBLICATIONS

Neumann et al.,'Drive System and Method for Operating a Drive System'—(DE102014004876B3_MT_1_.pdf), Apr. 2014 (Year: 2014).*
(Continued)

*Primary Examiner* — Kenneth J Hansen
(74) *Attorney, Agent, or Firm* — Crowell & Moring LLP

(57) ABSTRACT

A method monitors the state of a device having a first drive cylinder for receiving hydraulic fluid and a first drive piston which is movably arranged in the first drive cylinder. The method determines a speed of the first drive piston, establishes a difference between the determined speed of the first drive piston and an expected speed of the first drive piston, and determines a faulty state as a function of the difference established between the determined speed of the first drive piston and the expected speed of the first drive piston.

9 Claims, 1 Drawing Sheet

(51) Int. Cl.
*F04B 49/06* (2006.01)
*F04B 49/10* (2006.01)
*F04B 51/00* (2006.01)

(52) U.S. Cl.
CPC ..... *F04B 49/103* (2013.01); *F04B 2201/0202* (2013.01)

(56) References Cited

U.S. PATENT DOCUMENTS

| | | | |
|---|---|---|---|
| 6,192,299 | B1 | 2/2001 | Kubota et al. |
| 7,287,964 | B2 | 10/2007 | Sanwald |
| 7,581,935 | B2 | 9/2009 | Hofmann et al. |
| 10,138,915 | B2 | 11/2018 | Bhaskar et al. |
| 2004/0167738 | A1 | 8/2004 | Miller |
| 2006/0245943 | A1 | 11/2006 | Hofmann et al. |
| 2009/0220358 | A1 | 9/2009 | Krivsky et al. |
| 2015/0007713 | A1* | 1/2015 | Aki ..... F15B 15/2815 91/1 |
| 2018/0170733 | A1 | 6/2018 | Leichnitz et al. |
| 2019/0072118 | A1 | 3/2019 | Zientara et al. |

FOREIGN PATENT DOCUMENTS

| | | | |
|---|---|---|---|
| DE | 31 42 811 | A1 | 5/1983 |
| DE | 33 29 705 | A1 | 3/1985 |
| DE | 34 17 293 | A1 | 11/1985 |
| DE | 29 43 134 | C2 | 6/1989 |
| DE | 38 34 678 | A1 | 4/1990 |
| DE | 198 06 544 | A1 | 8/1998 |
| DE | 10 2004 015 416 | A1 | 10/2005 |
| DE | 10 2014 205 042 | A1 | 9/2015 |
| EP | 0 562 398 | A1 | 9/1993 |
| EP | 0 838 589 | A2 | 4/1998 |
| EP | 1 437 178 | A2 | 7/2004 |
| EP | 2 123 594 | A1 | 11/2009 |
| EP | 3 336 050 | A1 | 6/2018 |
| JP | 10-281113 | A | 10/1998 |
| JP | 11-82312 | A | 3/1999 |
| JP | 2005-98230 | A | 4/2005 |
| JP | 2014-105766 | A | 6/2014 |
| WO | WO 90/04104 | A1 | 4/1990 |
| WO | WO 2009/141242 | A1 | 11/2009 |
| WO | WO 2015/195246 | A1 | 12/2015 |

OTHER PUBLICATIONS

Hindi-language Office Action issued in Indian Application No. 202237007136 dated Aug. 1, 2023 with English translation (7 pages).

Chinese-language Office Action issued in Chinese Application No. 202080059376.3 dated Mar. 15, 2023 (9 pages).

International Search Report (PCT/ISA/210) issued in PCT Application No. PCT/EP2020/073337 dated Sep. 23, 2020 with English translation (six (6) pages).

German-language Written Opinion (PCT/ISA/237) issued in PCT Application No. PCT/EP2020/073337 dated Sep. 23, 2020 (seven (7) pages).

Japanese-language Office Action issued in Japanese Application No. 2022-511293 dated Dec. 19, 2023 with English translation (11 pages).

* cited by examiner

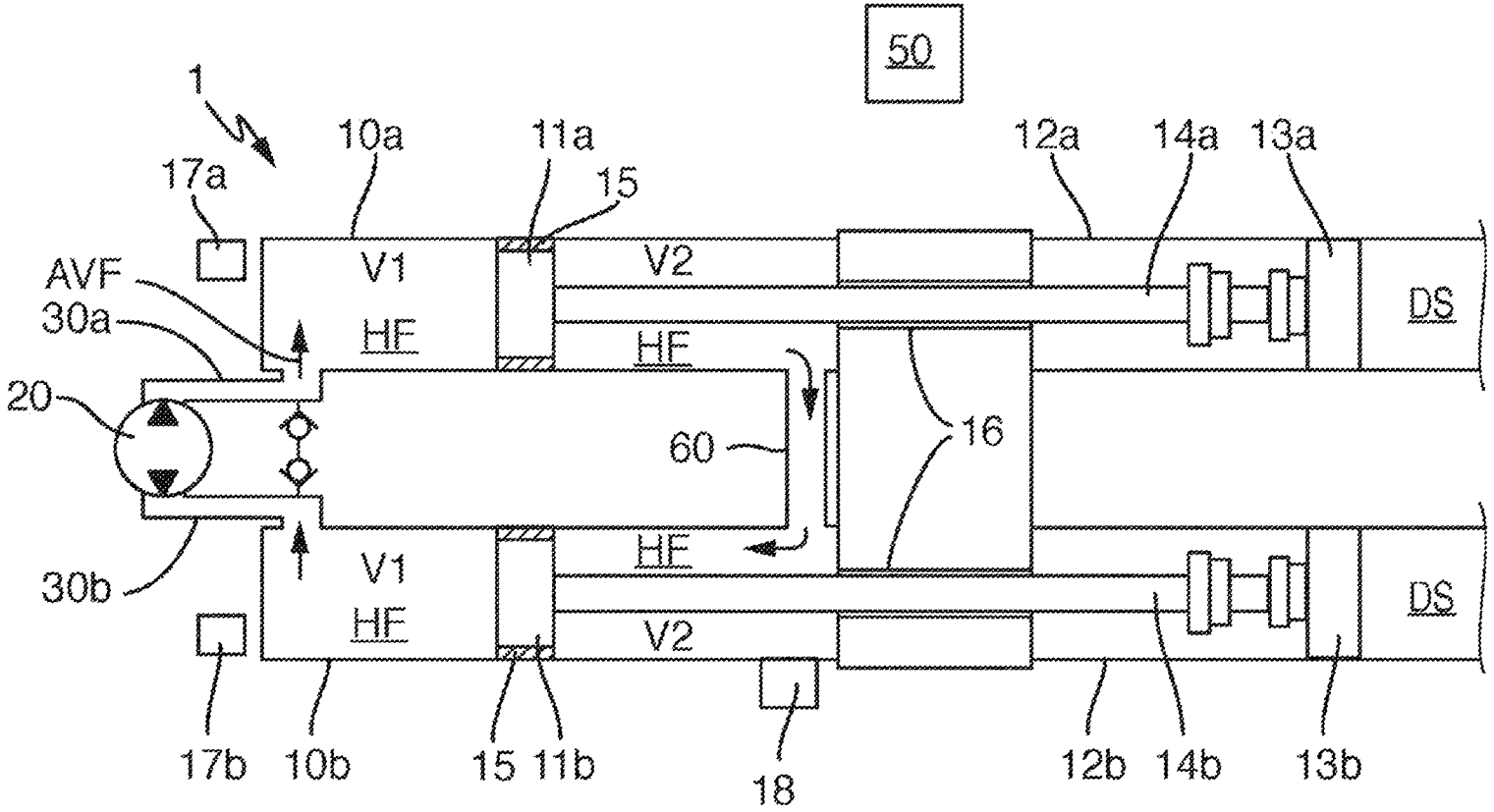
50
DS
DS
13a
13b
14a
14b
12a
12b
16
18
60
V2
HF
HF
V2
15
11a
11b
15
10a
V1
HF
V1
HF
10b
1
17a
17b
AVF
30a
20
30b

METHOD FOR MONITORING THE STATE OF A DEVICE AND DEVICE

BACKGROUND AND SUMMARY OF THE INVENTION

The invention relates to a method for monitoring the state of a device, in particular for delivering thick matter, and a device, in particular for delivering thick matter.

The invention is based on the object of providing a method for monitoring the state of a device, in particular for delivering thick matter, and a device, in particular for delivering thick matter, which enable reliable state detection.

The inventive method serves for monitoring the state of a device, in particular for delivering thick matter, for example in the form of liquid concrete. The device may be a concrete pump, for example.

The device has a conventional first drive cylinder for receiving hydraulic fluid, for example in the form of hydraulic oil.

The device further has a conventional first drive piston, which is movably, in particular longitudinally movably, arranged in the first drive cylinder.

The method has the following steps.

Determining a speed of the first drive piston, in particular in the longitudinal direction of the first drive cylinder. The determined speed can be the current speed of the drive piston, which, by way of example, can be determined continuously or only at certain positions of the drive piston. In addition, a speed profile of the first drive piston can also be determined. The first speed can be determined by means of a conventional distance measurement system, for example, by means of which a position of the first drive piston can be identified. The first speed can then be calculated via the temporal derivative of the determined position. The first speed can also be determined on the basis of a stroke time between two defined points of the drive cylinder.

Calculating a difference between the determined speed of the first drive piston and an expected speed of the first drive piston. The expected speed is, for example, the speed with which the first drive piston should theoretically move, in particular at a specified position, when functioning correctly. The expected speed can be determined, for example, based on a knowledge of the properties of the device, such as piston geometries, cylinder geometries, known or measured drive volume flows, etc., or is known a priori.

Identifying a fault state of the device or components of the device according to the calculated difference or a value of the calculated difference between the determined speed of the first drive piston and the expected speed of the first drive piston.

If the speed is derived from the stroke time, the stroke time and/or the change in the stroke time compared to the expected values in each case can serve as a fault criterion.

Typically, the first drive piston and the first delivery piston each execute a purely translatory, oscillating movement with a certain stroke.

With regard the above-mentioned conventional elements of the device, please also refer to the appropriate specialist literature.

According to an embodiment, the fault state is identified when the difference between the determined speed of the first drive piston and the expected speed of the first drive piston exceeds an associated value. Alternatively or in addition, the fault state is identified when a temporal change or derivative of the difference between the determined speed of the first drive piston and the expected speed of the first drive piston exceeds an associated value. The associated value in each case can be an absolute value or a relative value.

By way of example, the fault state can be identified when the difference between the determined speed of the first drive piston and the expected speed of the first drive piston exceeds a specified percentage value of the expected speed or the measured speed. The specified percentage value can be in a range between 0.1% and 10% of the expected speed or the measured speed, for example. Accordingly, the fault state can be determined when the temporal change or derivative of the difference between the determined speed of the first drive piston and the expected speed of the first drive piston per unit time, for example 60 seconds, exceeds a specified percentage value of the expected speed or the measured speed. The specified percentage value can be in a range between 0.1% and 10% of the expected speed or the measured speed, for example.

According to an embodiment, the device further has a conventional drive pump, which is designed to generate a drive volume flow of hydraulic fluid for moving the first drive piston in the first drive cylinder. In this respect, please also refer to the appropriate prior art. The expected speed is then calculated according to the generated drive volume flow, wherein typically known geometries and associated volumes of the hydraulic circuit are taken into account for this.

According to an embodiment, the device is a device for delivering thick matter and further has: a conventional first delivery cylinder for receiving and releasing thick matter, a conventional first delivery piston, which is movably, in particular longitudinally movably, arranged in the first delivery cylinder, a conventional first piston rod, which is fastened to the first drive piston and to the delivery piston for coupled movement of the first drive piston and the first delivery piston, a piston seal, which, in the non-defective or normal state, seals off a first volume or a drive-pump-side volume in the first drive cylinder with respect to a second volume or a swing volume in the first drive cylinder in conjunction with the first drive piston, and a rod seal, which seals off the first drive cylinder with respect to an environment of the device in conjunction with the first piston rod. In this case, the fault state in the form of a defect of the piston seal and/or in the form of a defect of the rod seal is identified according to the calculated difference between the determined speed of the first drive piston and the expected speed of the first drive piston.

According to an embodiment, the method has the following further steps: introducing a drive-pump-side drive volume flow and identifying the fault state in the form of the defect of the piston seal during the introduction of the drive-pump-side drive volume flow according to the calculated difference between the determined speed of the first drive piston and the expected speed of the first drive piston.

According to an embodiment, the method has the following further steps: introducing a swing-volume-side drive volume flow and identifying the fault state in the form of the defect of the rod seal during the introduction of the swing-volume-side drive volume flow according to the calculated difference between the determined speed of the first drive piston and the expected speed of the first drive piston.

According to an embodiment, the device for delivering thick matter further has: a second drive cylinder for receiving hydraulic fluid, a second drive piston, which is movably arranged in the second drive cylinder, a second delivery cylinder for receiving and releasing thick matter, a second delivery piston, which is movably arranged in the second delivery cylinder, and a second piston rod, which is fastened to the second drive piston and to the second delivery piston for coupled movement of the second drive piston and the second delivery piston. The first drive piston separates a first volume or a drive-pump-side volume from a second volume or swing volume in the first drive cylinder. Accordingly, the second drive piston separates a first volume or drive-pump side volume from a second volume or swing volume in the second drive cylinder. The swing volume in the first drive cylinder and the swing volume in the second drive cylinder are connected to one another via a swing connection for exchanging hydraulic fluid in such a way that the first drive piston moves in phase opposition to the second drive piston. In this case, the speed of the second drive piston is determined, wherein the expected speed of the first drive piston is the same as the determined speed of the second drive piston. In other words, the determined speed of the first drive piston is compared to the determined speed of the second drive piston, wherein the fault state is identified when the determined speeds deviate from one another by more than a specified value or when the temporal change in the difference of the determined speeds exceeds a specified value. If wear on the piston or rod seals can be ruled out, a fault/wear in the rest of the hydraulic system (in particular the hydraulic pumps) may also be detected in the event of deviation in the piston speeds.

According to an embodiment, hydraulic fluid is supplied to or discharged from a swing volume. The swing volume is formed by the swing volume in the first drive cylinder, the swing volume in the second drive cylinder and a volume of the swing connection. The supply or discharge procedure takes place in such a way that a possible or maximum stroke of an oscillating movement of the first drive piston and the second drive piston has a desired value. The swing connection results in the first drive cylinder and the second drive cylinder executing oscillating movements in phase opposition to one another, whereof the maximum stroke in each case depends on the swing volume. The stroke can therefore be adjusted by altering the swing volume.

According to an embodiment, the fault state is identified when a frequency of the supply or discharge procedure exceeds a specified value. The specified value for the frequency can be determined empirically through a series of tests, for example. By way of example, frequencies of fewer than or equal to 1 supply or discharge procedure per hour can be defined as fault-free and frequencies of more than 1 supply or discharge procedure per hour can be defined as faulty. Alternatively or in addition, a fault state of the device can be determined when a temporal change or derivative of the frequency of the supply or discharge procedure exceeds a specified value. By way of example, a fault state of the device can be determined when the temporal change in the frequency of the supply or discharge procedure per unit time, for example 60 seconds, exceeds a specified percentage value of the expected frequency or the measured frequency. The specified percentage value can be in a range between 0.1% and 10% of the expected frequency or the measured frequency, for example. Alternatively or in addition, a fault state of the device can be determined when a supplied or discharged volume exceeds a specified value. The specified value for the volume can be determined empirically through a series of tests, for example.

The device, in particular for delivering thick matter, as described further above, is designed to execute the method described above.

The invention is described in detail below with reference to the drawing.

BRIEF DESCRIPTION OF THE DRAWING

FIG. 1 is an embodiment of an inventive device for delivering thick matter.

DETAILED DESCRIPTION OF THE DRAWING

FIG. 1 shows an inventive device 1 for delivering thick matter DS. The device 1 may embody a concrete pump, for example.

The device 1 has a first drive cylinder 10*a* for receiving hydraulic fluid HF.

The device 1 further has a first drive piston 11*a*, which is longitudinally movably arranged in the first drive cylinder 10*a*.

The device 1 further has a first delivery cylinder 12*a* for receiving and releasing thick matter DS in the form of liquid concrete.

The device 1 further has a first delivery piston 13*a*, which is longitudinally movably arranged in the first delivery cylinder 12*a*.

The device 1 further has a first piston rod 14*a*, which is fastened to the first drive piston 11*a* for coupled movement with the first delivery piston 13*a*.

The device 1 further has a second drive cylinder 10*b* for receiving hydraulic fluid HF.

The device 1 further has a second drive piston 11*b*, which is longitudinally movably arranged in the second drive cylinder 10*b*.

The device 1 further has a second delivery cylinder 12*b* for receiving and releasing thick matter DS.

The device 1 further has a second delivery piston 13*b*, which is longitudinally movably arranged in the second delivery cylinder 12*b*.

The device 1 further has a second piston rod 14*b*, which is fastened to the second drive piston 11*b* for coupled movement with the second delivery piston 13*b*.

The first drive piston 11*a* separates a drive-pump-side volume V1 from a swing volume V2 in the first drive cylinder 10*a*. Accordingly, the second drive piston 10*b* separates a drive-pump-side volume V1 from a swing volume V2 in the second drive cylinder 10*b*. The swing volume V2 in the first drive cylinder 10*a* and the swing volume V2 in the second drive cylinder 10*b* are connected to one another via a swing connection 60 for exchanging hydraulic fluid HF in such a way that the first drive piston 11*a* moves in phase opposition to the second drive piston 11*b*.

The device 1 further has piston seals 15, which, in the non-defective state, seal off the drive-pump-side volumes V1 with respect to the swing volumes V2 in conjunction with the first drive piston 11*a* or the second drive piston 11*b*. Rod seals 16 are further provided, which seal off the first drive cylinder 10*a* or the second drive cylinder 10*b* with respect to an environment in conjunction with the first piston rod 14*a* or the second piston rod 14*b*.

The device 1 further has a drive pump 20, which is designed to generate the drive volume flows AVF of the hydraulic fluid HF. The drive pump 20 is connected to the drive-pump-side volumes V1 via pump connections 30*a* and 30*b* to move the first drive piston 11*a* in the first drive cylinder 10*a* or to move the second drive piston 11*b* in the second drive cylinder 10*b*. The drive pump 20 can optionally supply a drive volume flow AVF either via the pump connection 30*a* or the pump connection 30*b*, so that either the first drive piston 11*a* or the second drive piston 11*b* moves to the right, wherein the other drive piston in each case then moves to the left owing to the coupling via the swing connection 60.

The drive pump 20 is controlled in such a way that drive pistons 11*a* or 11*b* driven via the active pump connection 30*a* or 30*b* move to the right as far as a desired reversal point. Owing to the swing connection, the other drive piston 11*a* or 11*b* then moves to the left as far as an opposite reversal point. The first drive piston 11*a* and the second drive piston 11*b* therefore each execute a purely translatory movement, oscillating between two reversal points.

With regard to the hitherto described components and functions known from the prior art, please refer to the appropriate specialist literature.

To detect the position of the drive cylinders 10*a* and 10*b*, associated position sensors 17*a* or 17*b* are provided. The respective current speed of the first drive piston 11*a* or the second drive piston 11*b* is determined via a temporal derivative of the piston positions detected by means of the position sensors 17*a* or 17*b*.

A control unit 50 controls the operation of the device 1.

According to the invention, a speed of the first drive piston 11*a* and/or the second drive piston 11*b* is determined by means of the position sensors 17*a* or 17*b*, then a difference between the determined speeds of the first drive piston 11*a* and/or the second drive piston 11*b* and an expected speed of the first drive piston 11*a* and/or the second drive piston 11*b* is calculated, and finally a fault state is established according to the one or more calculated differences.

By way of example, the fault state can be established when the difference between the determined speed and the expected speed exceeds an associated value, and/or when a temporal change in the difference between the determined speed and the expected speed exceeds an associated value.

The expected speed can be calculated according to the generated drive volume flow AVF, for example.

The expected speed of one of the two drive pistons 11*a* or 11*b* can also correspond to the measured speed of the other drive piston 11*a* or 11*b*. In other words, the determined speed of the first drive piston 11*a* is compared to the determined speed of the second drive piston 11*b*, wherein the fault state is identified when the determined speeds deviate from one another by more than a predetermined value, or when the temporal change in the difference between the determined speeds exceeds a specified value.

The fault state can correspond to a defect in the piston seal(s) 15 and/or a defect in the rod seal(s) 16. By way of example, a defect in the piston seal(s) can be determined during the introduction of the drive-pump-side drive volume flow AVF according to the calculated difference between the determined speed and the expected speed. A defect in the rod seal(s) 15 can accordingly be determined during the introduction of the swing-volume-side drive volume flow AVF according to the calculated difference between the determined speed and the expected speed.

In the event that a stroke and/or a reversal position of the drive piston 11*a* or 11*b* does not/do not correspond to the associated set values, the stroke can be adjusted by supplying or discharging hydraulic fluid HF into or from a swing volume, which is formed by the swing volume V2 in the first drive cylinder 10*a*, the swing volume V2 in the second drive cylinder 10*b* and a volume of the swing connection 60. The supply or discharge of hydraulic fluid HF into or from the swing volume can take place via conventional components, which are known from the prior art. These components are denoted by way of example by the reference sign 18.

In this case, a fault state can be determined when a frequency of the supply or release procedure and/or a supplied or discharged volume exceeds a specified value.

The device can, of course, have further components known from the prior art, for example switching means for connecting the delivery cylinders 12*a* and 12*b* to a thick-matter delivery line or a thick-matter source, etc. Since these components are sufficiently known, a description thereof is omitted.

The inventive method for detecting a state or wear can be supplemented by taking into account further variables, for example a hydraulic pressure and/or a temperature of the hydraulic fluid. In addition, a history of the measured variables can be evaluated.

As a result of the invention, it is possible to identify wear on components of the device 1 and therefore to warn against or prevent failure of the components. This increases the availability of the device 1, since a necessary service can be planned specifically. Moreover, the servicing effort can also be significantly reduced as a result of the automated localization of the wear.

The invention claimed is:

1. A method for monitoring a state of a device equipped with a first drive cylinder for receiving hydraulic fluid and a first drive piston which is movably arranged in the first drive cylinder, the method comprising:

determining a speed of the first drive piston;

calculating a difference between the determined speed of the first drive piston and an expected speed of the first drive piston; and identifying a fault state according to the calculated difference between the determined speed of the first drive piston and the expected speed of the first drive piston, wherein the device delivers thick matter and is further equipped with:

a first delivery cylinder for receiving and releasing thick matter, a first delivery piston, which is movably arranged in the first delivery cylinder, and a first piston rod, which is fastened to the first drive piston and to the first delivery piston for coupled movement of the first drive piston and the first delivery piston, a piston seal, which, in the non-defective state, seals off a drive-pump-side volume in the first drive cylinder with respect to a swing volume in the first drive cylinder in conjunction with the first drive piston, and a rod seal, which seals off the first drive cylinder with respect to an environment in conjunction with the first piston rod, the method further comprising:

identifying the fault state in the form of a defect in the piston seal and/or in the form of a defect in the rod seal according to the calculated difference between the determined speed of the first drive piston and the expected speed of the first drive piston.

2. The method as claimed in claim 1, wherein the fault state is determined:

(i) when the difference between the determined speed of the first drive piston and the expected speed of the first drive piston exceeds an associated value, and/or (ii) when a temporal change in the difference between the determined speed of the first drive piston and the expected speed of the first drive piston exceeds an associated value.

3. The method as claimed in claim 1, wherein the device is further equipped with a drive pump that generates a drive volume flow of hydraulic fluid for moving the first drive piston in the first drive cylinder, the method further comprising:

calculating the expected speed according to the generated drive volume flow.

4. The method as claimed in claim 1, further comprising:

introducing a drive-pump-side drive volume flow; and identifying the fault state in the form of the defect in the piston seal during the introduction of the drive-pump-side drive volume flow according to the calculated difference between the determined speed of the first drive piston and the expected speed of the first drive piston.

5. The method as claimed in claim 1, further comprising:

introducing a swing-volume-side drive volume flow; and identifying the fault state in the form of the defect in the rod seal during the introduction of the swing-volume-side drive volume flow according to the calculated difference between the determined speed of the first drive piston and the expected speed of the first drive piston.

6. The method as claimed in claim 1, wherein the device is further equipped with a second drive cylinder for receiving hydraulic fluid, a second drive piston, which is movably arranged in the second drive cylinder, a second delivery cylinder for receiving and releasing thick matter, a second delivery piston, which is movably arranged in the second delivery cylinder, and a second piston rod, which is fastened to the second drive piston and to the second delivery piston for coupled movement of the second drive piston and the second delivery piston, wherein the first drive piston separates a drive-pump-side volume from a swing volume in the first drive cylinder, wherein the second drive piston separates a drive-pump-side volume from a swing volume in the second drive cylinder, and wherein the swing volume in the first drive cylinder and the swing volume in the second drive cylinder are connected to one another via a swing connection for exchanging hydraulic fluid in such a way that the first drive piston moves in phase opposition to the second drive piston, the method further comprising:

determining a speed of the second drive piston, wherein the expected speed of the first drive piston is the same as the determined speed of the second drive piston.

7. The method as claimed in claim 6, further comprising:

supplying or discharging hydraulic fluid to or from a swing volume, which is formed by the swing volume in the first drive cylinder, the swing volume in the second drive cylinder and a volume of the swing connection in such a way that a stroke of an oscillating movement of the first drive piston and the second drive piston has a desired value.

8. The method as claimed in claim 7, further comprising:

identifying the fault state when a frequency of the supply or discharge procedure and/or a temporal change of the frequency of the supply or discharge procedure and/or a supplied or discharged volume exceeds specified value.

9. A device that delivers thick matter, comprising:

a first drive cylinder for receiving hydraulic fluid;

a first drive piston which is movably arranged in the first drive cylinder;

a first delivery cylinder for receiving and releasing the thick matter, a first delivery piston, which is movably arranged in the first delivery cylinder, and a first piston rod, which is fastened to the first drive piston and to the first delivery piston for coupled movement of the first drive piston and the first delivery piston;

a piston seal, which, in a non-defective state, seals off a drive-pump-side volume in the first drive cylinder with respect to a swing volume in the first drive cylinder in conjunction with the first drive piston; and a rod seal, which seals off the first drive cylinder with respect to an environment in conjunction with the first piston rod; and a control unit operatively configured to:

determine a speed of the first drive piston;

calculate a difference between the determined speed of the first drive piston and an expected speed of the first drive piston;

identify a fault state according to the calculated difference between the determined speed of the first drive piston and the expected speed of the first drive piston, wherein the fault state is identified in the form of a defect in the piston seal and/or in the form of a defect in the rod seal according to the calculated difference between the determined speed of the first drive piston and the expected speed of the first drive piston.

* * * * *